United States Patent [19]

Naz

[11] 4,076,142

[45] Feb. 28, 1978

[54] SELF-VENTING BOTTLE CLOSURE

[76] Inventor: John F. Naz, 6523 Wellesley Terrace, Waterford, Mich. 48095

[21] Appl. No.: 760,362

[22] Filed: Jan. 19, 1977

[51] Int. Cl.[2] ..... B65D 51/16

[52] U.S. Cl. ..... 215/307; 215/260; 215/270; 215/271

[58] Field of Search ..... 215/307, 260, 270, 271

[56] References Cited

U.S. PATENT DOCUMENTS

| | | | |
|---|---|---|---|
| 3,944,104 | 3/1976 | Watson | 215/307 |

FOREIGN PATENT DOCUMENTS

| | | | |
|---|---|---|---|
| 522,210 | 9/1953 | Belgium | 215/307 |
| 1,424,369 | 11/1965 | France | 215/307 |
| 1,255,197 | 4/1960 | France | 215/307 |
| 86,114 | 10/1963 | France | 215/307 |
| 2,326,512 | 12/1974 | Germany | 215/307 |
| 175,820 | 1/1973 | Germany | 215/307 |
| 200,946 | 5/1958 | Germany | 215/307 |
| 1,005,796 | 4/1957 | Germany | 215/307 |
| 552,146 | 11/1956 | Italy | 215/307 |
| 3,745 of | 1901 | United Kingdom | 215/307 |
| 729,903 | 5/1955 | United Kingdom | 215/307 |

*Primary Examiner*—Ro E. Hart
*Attorney, Agent, or Firm*—Harness, Dickey & Pierce

[57] ABSTRACT

In champagne and other types of effervescent wines which generate gases when bottled and enclosed by a cork which is used as a stopper, the cork is usually wired to the mouth of the bottle to prevent it from being blown therefrom should the pressure build up sufficiently therewithin. When the wire is removed and the cork moved from side to side, it will be released from the neck of the bottle and shot therefrom with a substantial force. A towel is usually wound over the cork and neck of the bottle before being released to prevent someone from being injured when the cork is blown from the bottle neck. The wire was eliminated when a hollow plastic stopper was developed as the pressure within the stopper was applied in all directions forcing the side against the inner surface of the bottle neck an amount corresponding to the increase in pressure. The present invention relates to changes in the hollow cork which permits the internal pressure to be released before the stopper is removed from the neck to thereby reduce the hazards of having the stopper violently ejected therefrom.

1 Claim, 5 Drawing Figures

Fig. 1.
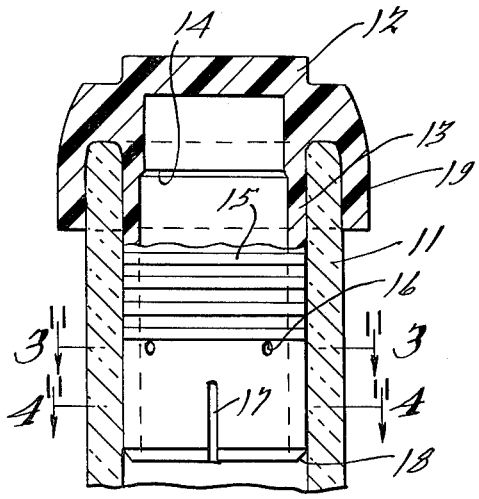
Fig. 3.
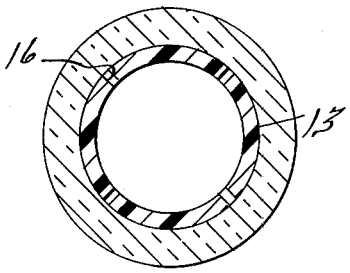
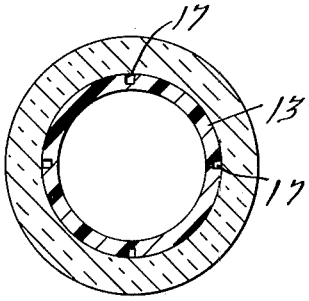
Fig. 4.
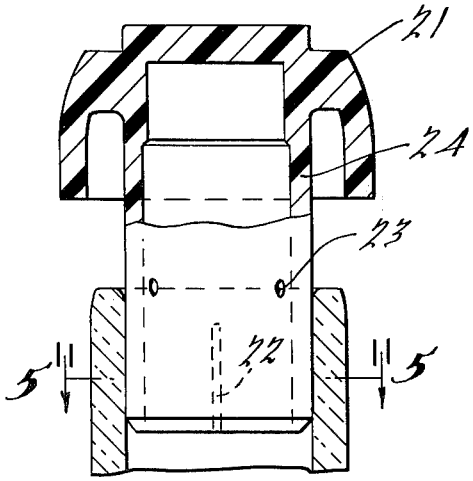
Fig. 2.
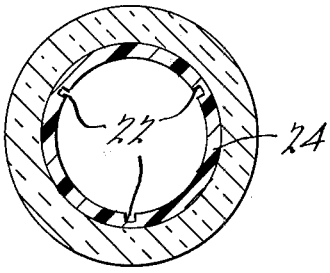
Fig. 5.

SELF-VENTING BOTTLE CLOSURE

BACKGROUND OF THE INVENTION

While the use of hollow plastic stoppers is old in the art, the treatment of the side wall to prevent the stopper from being violently released is believed to be new with applicant.

SUMMARY OF THE INVENTION

The invention pertains to the application of apertures through the plastic wall of the stopper between the top and bottom ends thereof to permit the trapped gas within the bottle and stopper to be expressed therefrom through the apertures after the stopper has been moved part way from the bottle neck. The stopper may have sealing ribs disposed annularly thereabout which forms individual seals with the internal wall of the bottle neck so as to provide assurance that the contents and gas will be trapped and retained within the bottle. Below the plurality of small openings through the wall of the stopper a number of vertically disposed recesses are provided in the wall from the inner or outer sides which are parallel to the central axis of the stopper. When the recesses are disposed on the inside, the entire outer surface of the wall will engage the inner wall of the bottle neck to provide an additional holding force at the bottom of the wall which will be sufficient to permit the gas to pass outwardly through the apertures when they reach the top of the bottle neck. When the recesses are provided on the outside of the stopper wall, a plurality of separate areas will engage the internal surface of the bottle neck to produce the same type of holding force. By providing the holding section or sections beneath the apertures sufficient holding force will be provided while the cork is being withdrawn from the bottle neck to permit the apertures to move beyond the top of the bottle neck so as to permit the internal generated gas to escape therethrough. This prevents the stopper from shooting from the mouth of the bottle with a substantial force which could injure anyone struck thereby.

BRIEF DESCRIPTION OF THE DRAWING

FIG. 1 is a view of a stopper within the neck of a bottle disclosed in section with recesses in the stopper wall on the exterior face thereof which embodies features of the present invention;

FIG. 2 is a view of structure similar to that illustrated in FIG. 1, showing a slightly different form of stopper which has been removed a sufficient amount to have the apertures through the wall disposed at the top of the neck of the bottle and with recesses disposed in the inner surface of the stopper wall;

FIG. 3 is a sectional view of the structure illustrated in FIG. 1, taken on the line 3—3 thereof;

FIG. 4 is a sectional view of the structure illustrated in FIG. 1, taken on the line 4—4 thereof, and FIG. 5 is a sectional view of the structure illustrated in FIG. 2, taken on the line 5—5 thereof.

DESCRIPTION OF THE PREFERRED EMBODIMENTS

In FIGS. 1, 3 and 4, a neck 11 of a bottle has a stopper 12 disposed therein for sealing the contents thereof. The stopper 12 is made of plastic material having a wall 13 providing a hollow interior 14 for the admission of a gas which is generated by the contents of the bottle such as that developed by a champagne. The gas within the hollow interior 14 expands in all directions and therefor provides a pressure against the inside of the wall 13 forcing the outside thereof into more firm engagement with the inside surface of the bottle neck. A plurality of ribs 15 are annularly disposed about the exterior wall of the stopper 12, each of which forms a sealing engagement with the interior surface of the wall of the bottle neck. Directly below the ribs 15 are a plurality of apertures 16 which extends through the wall 13 and communicates the interior of the stopper 14 to the exterior thereof.

Below the apertures 16 a plurality of recesses 17 extend inwardly from the outside surface of the wall 13 at the bottom end thereof. The pressure within the hollow interior 14 of the stopper moves the plurality of sections of the wall between the recesses 17 outwardly into engagement with the interior surface of the bottle neck to provide a substantial holding force which prevents the stopper from being forceably ejected when it has been moved outwardly a sufficient amount to expose the aperture 16 above the bottle neck to permit the gas under pressure to escape before the stopper has been loosened sufficiently to have it ejected by the built-up pressure within the bottle. The end of the wall 13 is chamfered at 18 to aid in the insertion of the stopper into the neck of the bottle after the contents has been poured therewithin. The stopper 12, as herein illustrated, has a skirt 19 extending downwardly in spaced relation to the wall 13 to receive the top of the bottle neck and prevent it from being damaged.

In FIGS. 2 and 5, a stopper 21 is illustrated which is the same as the stopper 12 of FIG. 1 with the exception that the ribs 15 have been omitted and recesses 22 are employed which extend outwardly from the inner wall of the stopper. The recesses 22, herein illustrated as three in number, permit the sections therebetween to expand and force the entire outer surface at the bottom of the stopper to engage the wall of the bottle neck and retain the stopper from being forceably ejected so that the gas under pressure can pass through the apertures 23 which extend through the wall 24 of the stopper. The recesses 17 and 22 permit the pressure within the interior of the stopper to expand the sections between the recesses outwardly and thereby provide a holding force at the bottom of the wall 24 of the stopper to be effective when the stopper is being removed to provide a holding force until the pressure is released through the apertures in the stopper wall. The stopper is made from a vinyl or like plastic material which retains its shape but has resiliency so as to conform to the shape of the bottle neck when the interior is subjected to pressure.

What is claimed is:

1. A stopper for the open end at the neck of a bottle having a gas pressure generated therewithin after the stopper has sealed the end thereof, means associated with the stopper to relieve the gas pressure within the bottle before the stopper is removed therefrom, annular ribs provided on the exterior wall of the stopper to form a plurality of sealing engagements with the interior wall of the bottle neck to seal the gas within the bottle, said stopper being hollow and provided with a resilient wall containing through apertures between the top and bottom ends through which the gas can escape when the stopper is partially removed from the bottle neck, the inner surface of the wall being provided with spaced recesses to divide the wall into joined sections which are forced outwardly by the pressure of the contained gas to circumferentially engage the wall and hold the stopper from being expelled from the bottle before the pressure is relieved.

* * * * *